US011448397B2

(12) United States Patent
Tsai

(10) Patent No.: US 11,448,397 B2
(45) Date of Patent: Sep. 20, 2022

(54) GAS COMBUSTOR AND SAFETY SWITCH THEREOF

(71) Applicant: ROBURN COMPANY LTD., New Taipei (TW)

(72) Inventor: Chin-Lin Tsai, New Taipei (TW)

(73) Assignee: ROBURN COMPANY LTD., New Taipei (TW)

( * ) Notice: Subject to any disclaimer, the term of this patent is extended or adjusted under 35 U.S.C. 154(b) by 14 days.

(21) Appl. No.: 16/875,294

(22) Filed: May 15, 2020

(65) Prior Publication Data

US 2020/0386402 A1 Dec. 10, 2020

(30) Foreign Application Priority Data

Jun. 6, 2019 (TW) ..... 108207284

(51) Int. Cl.

| | |
|---|---|
| ***F23D 14/28*** | (2006.01) |
| ***F23D 14/46*** | (2006.01) |
| ***F23D 14/58*** | (2006.01) |
| ***F23D 14/72*** | (2006.01) |
| ***F23Q 3/00*** | (2006.01) |
| ***F23D 14/02*** | (2006.01) |
| ***F23D 14/48*** | (2006.01) |
| ***F23D 14/38*** | (2006.01) |

(52) U.S. Cl.

CPC ..... *F23D 14/38* (2013.01); *F23D 14/28* (2013.01); *F23D 14/465* (2013.01); *F23D 14/58* (2013.01); *F23D 14/72* (2013.01)

(58) Field of Classification Search

CPC ..... F23D 14/28; F23D 14/38; F23D 14/465; F23D 14/58; F23D 14/72; F23D 2209/00; F23Q 3/002

See application file for complete search history.

(56) References Cited

U.S. PATENT DOCUMENTS 3,746,815 A * 7/1973 Drummer ..... H01H 9/06 200/43.17
4,006,334 A * 2/1977 Robotham ..... H01H 3/20 200/43.17
4,122,320 A * 10/1978 Edgell ..... H01H 9/06 200/43.17

(Continued)

FOREIGN PATENT DOCUMENTS

EP 1174892 A2 * 1/2002 ..... H01H 3/20

*Primary Examiner* — Jorge A Pereiro
*Assistant Examiner* — Logan P Jones
(74) *Attorney, Agent, or Firm* — Guice Patents PLLC

(57) ABSTRACT

A gas combustor includes: a housing, a storage cylinder, a fuel gas controlling device, an igniting device, a safety switch, and a combusting device. The safety switch has a fastening unit and a locking unit abutted against a locking bolt formed on a bottom surface of a press button; the fastening unit has an accommodation chamber allowing the locking unit to be accommodated, and a swing arm having a latching hook and longitudinally disposed at a front end of the accommodation chamber; the locking unit has a main body accommodated in the accommodation chamber, a longitudinal spring is disposed between the main body and the accommodation chamber, and the main body has a push button protruded from a penetrated slot longitudinally formed on a rear wall of the accommodation chamber, and a locking hook protruded towards the latching hook.

18 Claims, 10 Drawing Sheets

(56) References Cited

U.S. PATENT DOCUMENTS

| | | | | |
|---|---|---|---|---|
| 4,504,707 | A * | 3/1985 | Ochiai | H01H 3/20 200/43.17 |
| 6,293,782 | B1 * | 9/2001 | Tsai | F23D 14/28 431/153 |
| 6,296,476 | B1 | 10/2001 | Tsai | |
| 6,527,543 | B2 | 3/2003 | Tsai | |
| 7,708,554 | B2 | 5/2010 | Tsai | |
| 7,850,446 | B2 | 12/2010 | Tsai | |
| 2008/0057455 | A1 * | 3/2008 | Tsai | F23D 14/465 431/153 |
| 2009/0068606 | A1 * | 3/2009 | Tsai | F23Q 3/002 431/255 |
| 2009/0209991 | A1 * | 8/2009 | Hinchliffe | A61B 17/00 606/170 |
| 2010/0112501 | A1 * | 5/2010 | Tsai | F23D 14/28 431/153 |
| 2012/0244480 | A1 * | 9/2012 | Tsai | F23D 14/465 431/153 |
| 2018/0066842 | A1 * | 3/2018 | Tsai | F23D 14/00 |

* cited by examiner

A-A

B-B

GAS COMBUSTOR AND SAFETY SWITCH THEREOF

BACKGROUND OF THE INVENTION

1. Field of the Invention

The present invention relates to gas combustor, especially to a gas combustor having a safety switch, which can be in a locked status while not being operated, and capable of being processed with a pressing operation while being in an unlocked status.

2. Description of Related Art

At present, a lighter is used to replace matches for being served as a main component for generating a fire. Speaking of a conventional gas combustor, the conventional gas combustor has a stronger flame and is capable of being held and operated by a single hand of a user, and also provided with advantages of being portable and convenient in operation, thus the conventional gas combustor has been commonly favored and used by consumers.

Because the conventional gas combustor is prevail in domestic utilizations, children may play with the gas combustor by his/her own due to curiosity or imitation. As a result, a fire accident may happen due to careless operations, and human lives and property safety may be in danger. According to many fire accident cases, there are many cases caused by children carelessly playing with fires and accidents are therefore caused. The main reason is that the ignition switch of the conventional gas combustor is easily to be pressed and operated for a purpose of providing conveniences in use, thus the children have chances to press and operate the gas combustor, and unpredictable subsequences are caused.

In consideration of safety, many countries have issued safety regulations regarding to the gas combustor, and the gas combustor is forcedly required to be provided with a safety switch. U.S. Pat. No. 6,293,782 (corresponding to Taiwan Patent Registration No. 446104), U.S. Pat. No. 6,296,476 (corresponding to Taiwan Patent Registration No. 449018), U.S. Pat. No. 6,527,543 (corresponding to Taiwan Patent Registration No. 525749), U.S. Pat. No. 7,708,554 (corresponding to Taiwan Patent Registration No.M306647) and U.S. Pat. No. 7,850,446 (corresponding to Taiwan Patent Registration No. M338954) granted to the applicant of the present invention can be taken as obvious examples; when the gas combustor is not in an operating status, the above-mentioned safety switch is in a locked status; when being desired to be operated, the safety switch has to be firstly released for allowing fires to be generated. With the releasing operation required by the safety switch, the operation of the gas combustor becomes more difficult, so that the children can be prevented from releasing and playing with the gas combustor, and the possibility of accident occurrence can be reduced.

As such, how to additionally install the safety switch on the gas combustor for complying with the safety regulations of various countries shall be seriously concerned by the skilled people in the art.

SUMMARY OF THE INVENTION

One primary objective of the present invention is to provide a gas combustor, which has a safety switch capable of being manually unlocked, automatically locked and being pressed for operations, thereby increasing the safety in operation and the durability in use.

For achieving said objective, one technical solution provided by the present invention is to provide a gas combustor, which includes a housing used for enclosing a storage cylinder and a fuel gas controlling device disposed on a top end of the storage cylinder, a rear opening allowing a press button of an igniting device to protrude and a clamp slot allowing a safety switch to protrude are adjacently arranged on an upper portion defined on a back surface of the housing, and a front opening allowing a combusting device to be disposed is arranged on an upper portion defined at a front end of the housing; the fuel gas controlling device has a gas discharging press plate allowing the press button to be abutted and pivoted in the housing, a piezoelectric device is disposed in the press button, the piezoelectric device has an electric conducting wire extended to a flame nozzle of the combusting device and spaced from the flame nozzle with a gap; wherein the safety switch has a fastening unit and a locking unit abutted against a locking bolt formed on a bottom surface of the press button; the fastening unit has an accommodation chamber allowing the locking unit to be accommodated, and a swing arm having a latching hook is longitudinally disposed in front of the accommodation chamber with an interval; the locking unit has a main body accommodated in the accommodation chamber, a longitudinal spring is disposed between the main body and the accommodation chamber, and the main body has a push button protruded from a penetrated slot longitudinally formed on a rear wall of the accommodation chamber, and a locking hook protruded towards the latching hook; when the push bottom is not downwardly pushed, the locking hook is adjacently connected to the latching hook, and the locking bolt is abutted against the locking unit, thereby forming a non-pressing and locked status; when the push button is longitudinally and downwardly pushed, the longitudinal spring is compressed, and the locking hook at a top end of the main body is downwardly displaced along the latching hook for forming a mutual abutting status, so that the locking bolt is no longer abutted by the locking unit, thereby forming a pressing and unlocked status, the press button is able to be pressed for compressing the piezoelectric device, the gas discharging press plate is pressed for enabling the swing arm to be forwardly inclined so as to be deformed, the locking hook is released from the latching hook, so that the locking unit is able to be upwardly displaced due to an energy releasing status provided by the longitudinal spring for enabling a top surface of the locking unit to be in contact with the locking bolt.

According to one embodiment of the present invention, the fastening unit further has a vertical column arranged at a front end of the swing arm, a transversal spring is disposed between the vertical column and the swing arm; when the press button is in an automatically locked status, a releasing effect provided by the transversal spring is applied to the swing arm for assisting the locked status in a vertical direction to be recovered.

According to one embodiment of the present invention, two ends of the transversal spring are respectively sleeved on a first spring tenon and a second spring tenon oppositely arranged on the swing arm and the vertical column.

According to one embodiment of the present invention, at least one lateral wall of the accommodation chamber has an anti-releasing slot; the main body has an anti-releasing tenon received in the anti-releasing slot and arranged at a location corresponding to each of the anti-releasing slots, so that the locking unit is prevented from longitudinally releasing from the accommodation chamber.

According to one embodiment of the present invention, the longitudinal spring is sleeved between a spring slot and a spring column oppositely formed on the main body and the accommodation chamber.

According to one embodiment of the present invention, two lateral walls of the fastening unit are respectively formed with at least one positioning tenon, and an inner wall of the clamp slot of the housing is correspondingly formed with at least one positioning hole allowing the at least one positioning tenon to be inserted and positioned.

According to one embodiment of the present invention, the fuel gas controlling device has a gas discharging nozzle used for controlling whether fuel gas being supplied, the gas discharging nozzle is sleeved with one end of a gas conveying pipe, and another end of the gas conveying pipe is sleeved with a gas ejecting nozzle, a lifting plate disposed at one end of the gas discharging press plate is sleeved with the gas discharging nozzle, and a passive plate disposed at another end thereof is abutted against a push rod of the press button.

According to one embodiment of the present invention, the combusting device has a fastening seat made of a metal material, a seat hole allowing the flame nozzle to be disposed and a first wire slot allowing the electric conducting wire to pass are respectively formed at a central portion and a peripheral surface of the fastening seat, the gas discharging nozzle is combined with the flame nozzle formed with at least one air inlet hole on a peripheral surface thereof, the fastening seat is disposed in an end cover, and the end cover is arranged at the front opening.

According to one embodiment of the present invention, a press part protruded from of the rear opening is disposed at a rear side of the press button; and the piezoelectric device has a returning wire being in contact with the fastening seat.

According to one embodiment of the present invention, the press button is further connected to an auxiliary spring in a direction defined being parallel and opposite to the push rod, and two ends of the auxiliary spring are disposed at a button tenon of the press button and an inner wall of the housing.

According to one embodiment of the present invention, a heat insulation sleeve is disposed at an outer side of the flame nozzle, the heat insulation sleeve is a pipe member made of a ceramic material, and a peripheral surface thereof is formed with a second wire slot allowing the electric conducting wire to be received.

According to one embodiment of the present invention, a longitudinal sliding slot allowing a continuous button to be received is formed on a lateral surface, corresponding to a location where the press button is disposed, of the housing, an action stopping rod is inwardly protruded from the continuous button, an action stopping slot is formed in the press button corresponding to a moving path of the action stopping rod; when the press button is in the unlocked status and kept being pressed, the continuous button is upwardly pulled, thus the action stopping rod is displaced in the action stopping slot so as form a locked status, thus the press button is prevented from being elastically recovered, and an gas continuously supplying status is formed.

Another objective of the present invention is to provide a safety switch of a gas combustor, the safety switch has functions of manually unlocking and automatically locking, thereby increasing the safety in operation and the durability in use.

For achieving said objective, one technical solution provided by the present invention is to provide a safety switch of a gas combustor, which includes a fastening unit and a locking unit abutted against a locking bolt formed on a bottom surface of a press button; the fastening unit has an accommodation chamber allowing the locking unit to be accommodated, and a swing arm having a latching hook is longitudinally disposed in front of the accommodation chamber with an interval; the locking unit has a main body accommodated in the accommodation chamber, a longitudinal spring is disposed between the main body and the accommodation chamber, and the main body has a push button protruded from a penetrated slot longitudinally formed on a rear wall of the accommodation chamber, and a locking hook protruded towards the latching hook; when the push bottom is not downwardly pushed, the locking hook is adjacently connected to the latching hook, and the locking bolt is abutted against the locking unit, thereby forming a non-pressing and locked status; when the push button is longitudinally and downwardly pushed, the longitudinal spring is compressed, and the locking hook at a top end of the main body is downwardly displaced along the latching hook for forming a mutual abutting status, so that the locking bolt is no longer abutted by the locking unit, thereby forming a pressing and unlocked status, the swing arm is forwardly inclined and deformed, the locking hook is released from the latching hook, so that the locking unit is able to be upwardly displaced due to an energy releasing status provided by the longitudinal spring for enabling a top surface of the locking unit to be in contact with the locking bolt.

According to one embodiment of the present invention, the fastening unit further has a vertical column, a transversal spring is disposed between the vertical column and the swing arm; when the press button is in an automatically locked status, a releasing effect provided by the transversal spring is applied to the swing arm for assisting the locked status in a vertical direction to be recovered.

According to one embodiment of the present invention, two ends of the transversal spring are respectively sleeved on a first spring tenon and a second spring tenon oppositely arranged on the swing arm and the vertical column.

According to one embodiment of the present invention, at least one lateral wall of the accommodation chamber has an anti-releasing slot; the main body has an anti-releasing tenon received in the anti-releasing slot and arranged at a location corresponding to each of the anti-releasing slots, so that the locking unit is prevented from longitudinally releasing from the accommodation chamber.

According to one embodiment of the present invention, the longitudinal spring is sleeved between a spring slot and a spring column oppositely formed on the main body and the accommodation chamber.

According to one embodiment of the present invention, two lateral walls of the fastening unit are respectively formed with at least one positioning tenon, and an inner wall of the clamp slot of the housing is correspondingly formed with at least one positioning hole allowing the at least one positioning tenon to be inserted and positioned.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
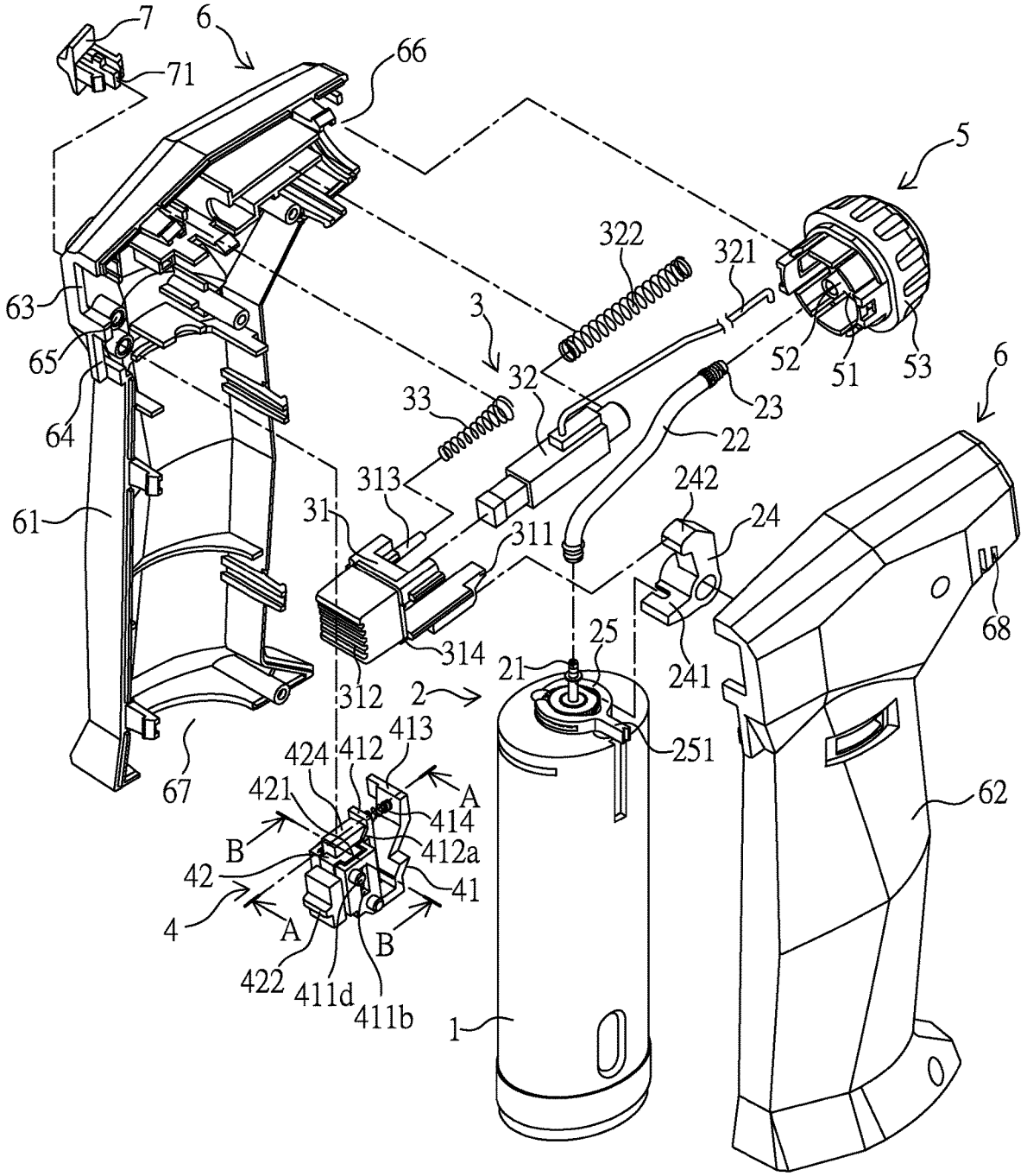
FIG. 1 is a perspective exploded view illustrating the gas combustor according the present invention.

Please refer from FIG. 1 to FIG. 9, a gas combustor including a storage cylinder 1, a fuel gas controlling device 2, an igniting device 3, a safety switch 4, a combusting device 5 and a housing 6 is provided by the present invention.

The storage cylinder 1 is used for storing liquid gas, and a bottom end thereof is disposed with a filling nozzle (not shown in figures due to a projection angle) which is used for replenishing fuel.

The fuel gas controlling device 2 is disposed at a top end of storage cylinder 1 and has a gas discharging nozzle 21 used for controlling whether fuel gas being supplied. The gas discharging nozzle 21 is sleeved with one end of a gas conveying pipe 22, and another end of the gas conveying pipe 22 is sleeved with a gas ejecting nozzle 23.

When the gas discharging nozzle 21 is pulled, and the liquid gas stored in the storage cylinder 1 is vaporized, the fuel gas is able to enter the gas conveying pipe 22 via the gas discharging nozzle 21, and rapidly ejected from the gas ejecting nozzle 23, so that the fuel gas is able to enter the combusting device 5 for enabling a combusting operation to be performed.

The fuel gas controlling device 2 further has a gas discharging press plate 24 pivoted in the housing 6, the gas discharging press plate 24 is preferably to be formed as an L-shaped rack member, a lifting plate 241 disposed at one end of the gas discharging press plate 24 is sleeved with the gas discharging nozzle 21, and a passive plate 242 disposed at another end of the gas discharging press plate 24 is abutted against a press button 31 of the igniting device 3. When the passive plate 242 of the gas discharging press plate 24 is pushed by a push rod 311 disposed at one side of the press button 31, a torque effect is generated for enabling the lifting plate 241 to be upwardly lifted, the gas discharging nozzle 21 is pulled, thereby forming a fuel gas supplying status; the fuel gas is allowed to pass the gas conveying pipe 22 and ejected from the gas ejecting nozzle 23 so as to enter the combusting device 5.

Moreover, an air adjusting ring 25 is further sleeved with the gas discharging nozzle 21, the air adjusting ring 25 is laterally extended with an adjusting rod 251 so as to be protruded from the housing 6, so that the adjusting rod 251 can be externally operated for enabling the air adjusting ring 25 to rotate the gas discharging nozzle 21 to adjust a discharging mount of the fuel gas.

The igniting device 3 has the press button 31 and a piezoelectric device 32 disposed in the press button 31. A push rod 311 abutted against the passive plate 242 is protruded from a front side of the press button 31, and a press part 312 protruded from of a rear opening 63 of the housing 6 is disposed at a rear side of the press button 31. The piezoelectric device 32 respectively has an electric conducting wire 321 extended to the combusting device 5 and a returning wire 322, for example a spring.

The press button 31 is further connected to an auxiliary spring 33 in a direction defined being parallel and opposite to the push rod 311, two ends of the auxiliary spring 33 are disposed at a button tenon 313 of the press button 31 and an inner wall of the housing 6, so that the auxiliary spring 33 can be served to assist the press button 31 to be elastically recovered to an initial location.

As shown from FIG. 1 to FIG. 6, the safety switch 4 has a fastening unit 41 and a locking unit 42 abutted against a locking bolt 314 on a bottom surface of the press button 31. The safety switch 4 is received in a clamp slot 64 located below the rear opening 63, and arranged below the press button 31.

The fastening unit 41 has an accommodation chamber 411 allowing the locking unit 42 to be accommodated, and a swing arm 412 having a latching hook 412*a* is longitudinally disposed in front of the accommodation chamber 411 with an interval. Wherein, a penetrated slot 411*a* is longitudinally formed on a rear wall of the accommodation chamber 411, and an anti-releasing slot 411*b* is formed on at least one lateral wall of thereof; the locking unit 42 has a main body 421 disposed in the accommodation chamber 411, a longitudinal spring 423 is disposed between the main body 421 and the accommodation chamber 411, so that the locking unit 42 is able to longitudinally and elastically displace in the fastening unit 41.

Moreover, the main body 421 has a push button 422 protruded from the penetrated slot 411*a*, and the main body 421 has an anti-releasing tenon 421*a* arranged at a location corresponding to each anti-releasing slot 411*b*, so that the locking unit 42 can be prevented from longitudinally releasing from the accommodation chamber 411 of the fastening unit 41.

Figure 5:
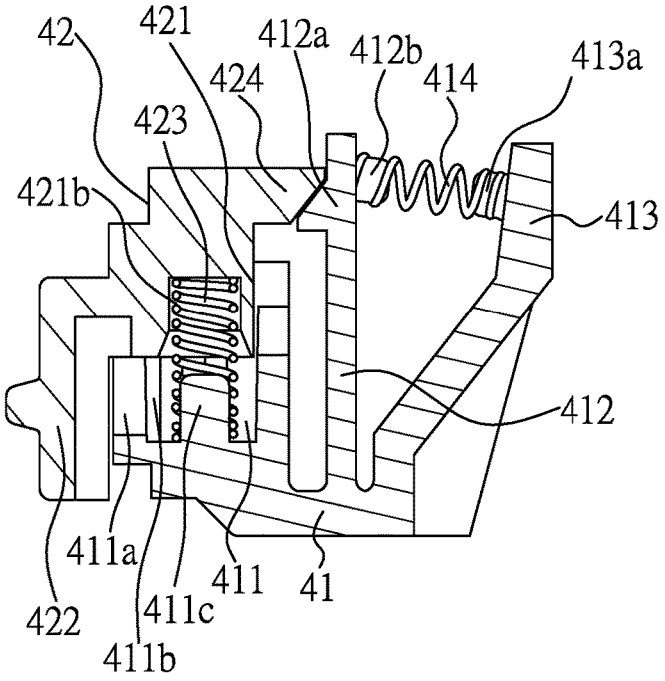
FIG. 5 is a cross sectional view of FIG. 1 taken along an A-A line.

Furthermore, the main body 421 has a locking hook 424 protruded towards the latching hook 412*a*; prefer refer to FIG. 5, when the locking unit 42 is not downwardly pressed, the locking hook 424 is abutted against the latching hook 412*a* of the swing arm 412. The longitudinal spring 423 is sleeved between a spring slot 421*b* and a spring column 411*c* oppositely formed on the main body 421 and the accommodation chamber 411.

Figure 2:
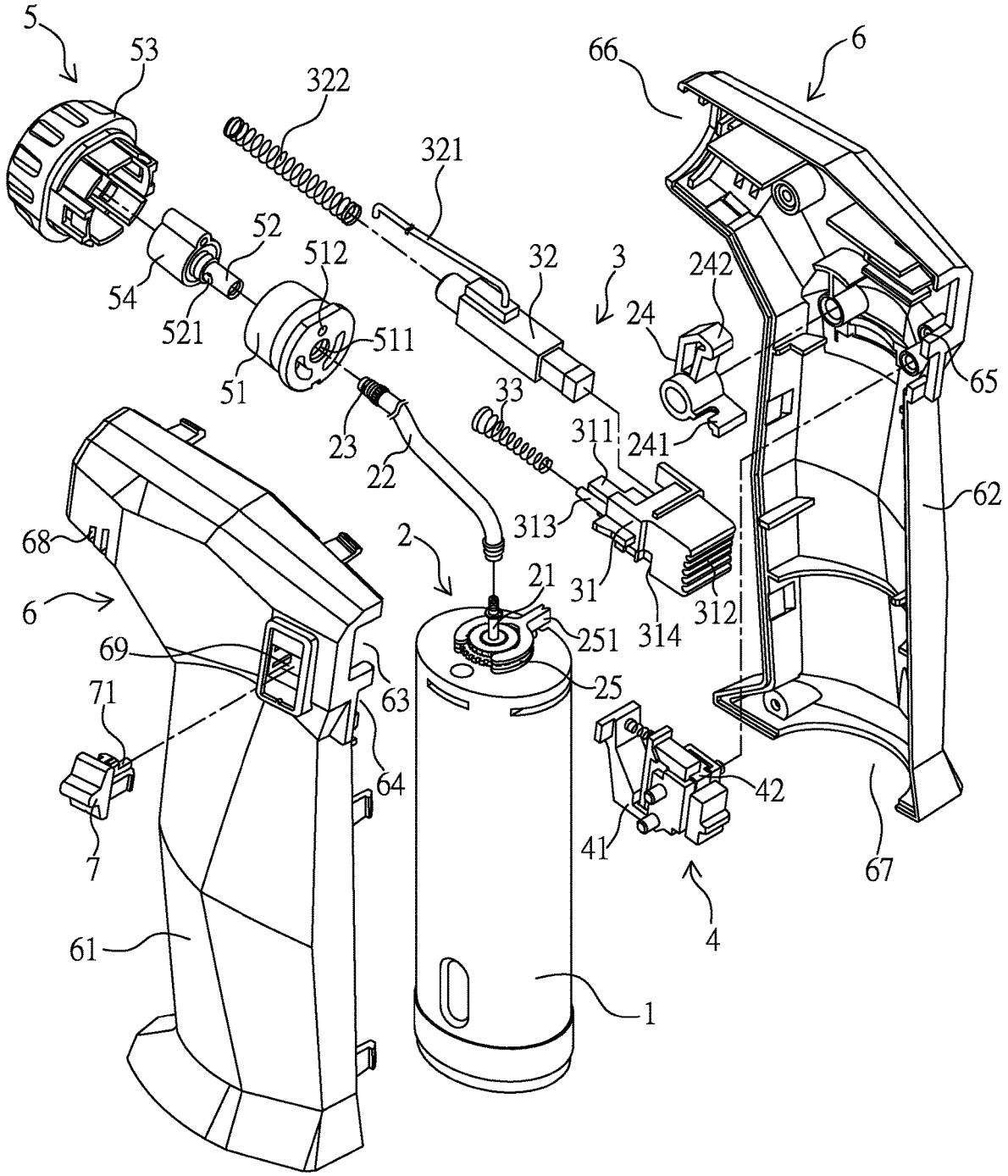
FIG. 2 is another perspective exploded view illustrating the gas combustor according the present invention.
Figure 3:
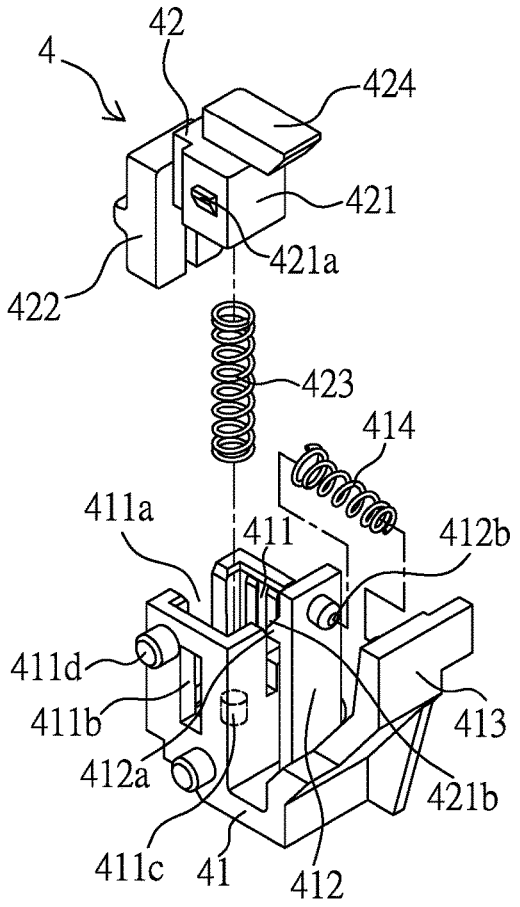
FIG. 3 is a perspective exploded view illustrating the safety switch according the present invention.
Figure 4:
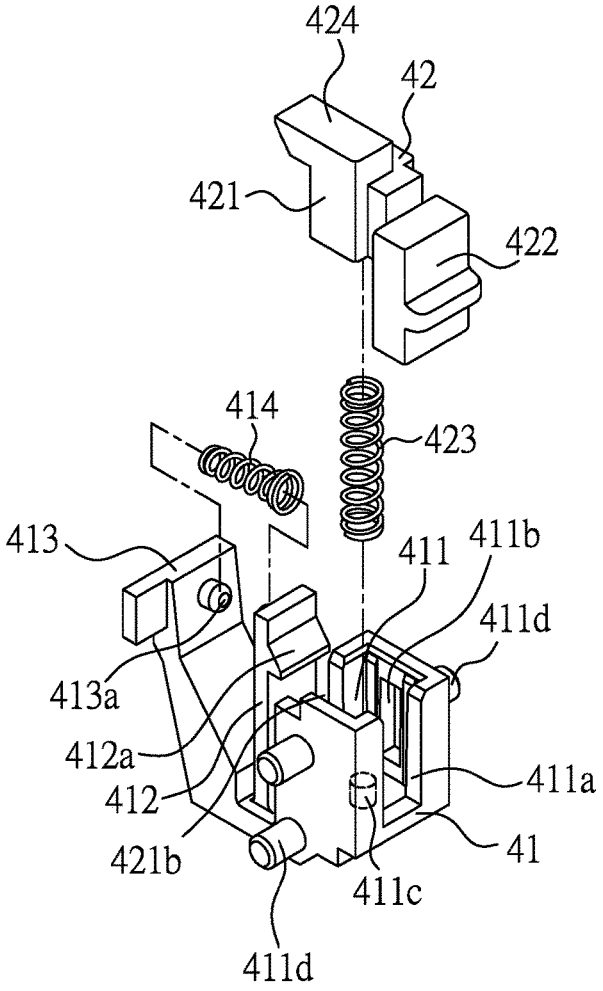
FIG. 4 is another perspective exploded view illustrating the safety switch according the present invention.

For allowing the safety switch 4 to be fastened in the housing 6, two lateral walls of the fastening unit 41 are respectively formed with at least one positioning tenon 411*d*, and an inner wall of the clamp slot 64 of the housing 6 is correspondingly formed with at least one positioning hole 65 (as shown in FIG. 1 and FIG. 2) allowing the at least one positioning tenon 411*d* to be inserted and positioned.

Moreover, the fastening unit 41 further has a vertical column 413 arranged at a front end of the swing arm 412, a transversal spring 414 is disposed between the vertical column 413 and the swing arm 412. When the press button 31 is in an automatically locked status, an energy releasing effect provided by the transversal spring 414 is applied to the swing arm 412 for assisting the locked status in a vertical direction thereof to be recovered. Two ends of the transversal spring 414 are respectively sleeved on a first spring tenon 412*b* and a second spring tenon 413*a* oppositely arranged on the swing arm 412 and the vertical column 413, so as to be prevented from falling out.

Figure 6:
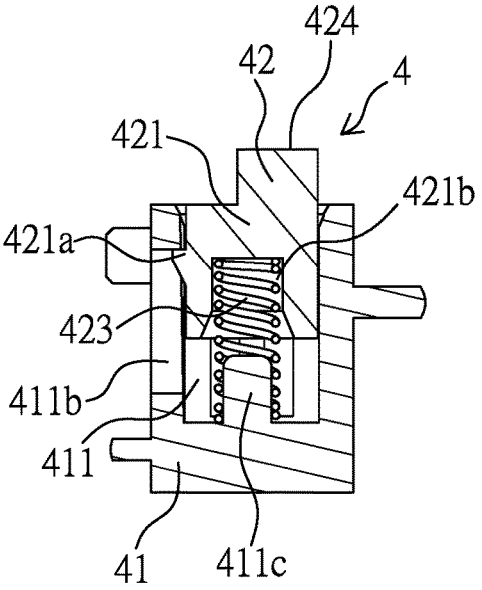
FIG. 6 is a cross sectional view of FIG. 1 taken along a B-B line.

Based on what has been illustrated above, the safety switch 4 as shown in FIG. 1 can be formed after the fastening unit 41 and the locking unit 42 are assembled, and FIG. 5 and FIG. 6 are cross sectional views illustrating the assembly of the safety switch 4. Operations of manual unlocking and automatically locking of the safety switch 4 and the press button 31 will be provided later according to the present invention.

Figure 7:
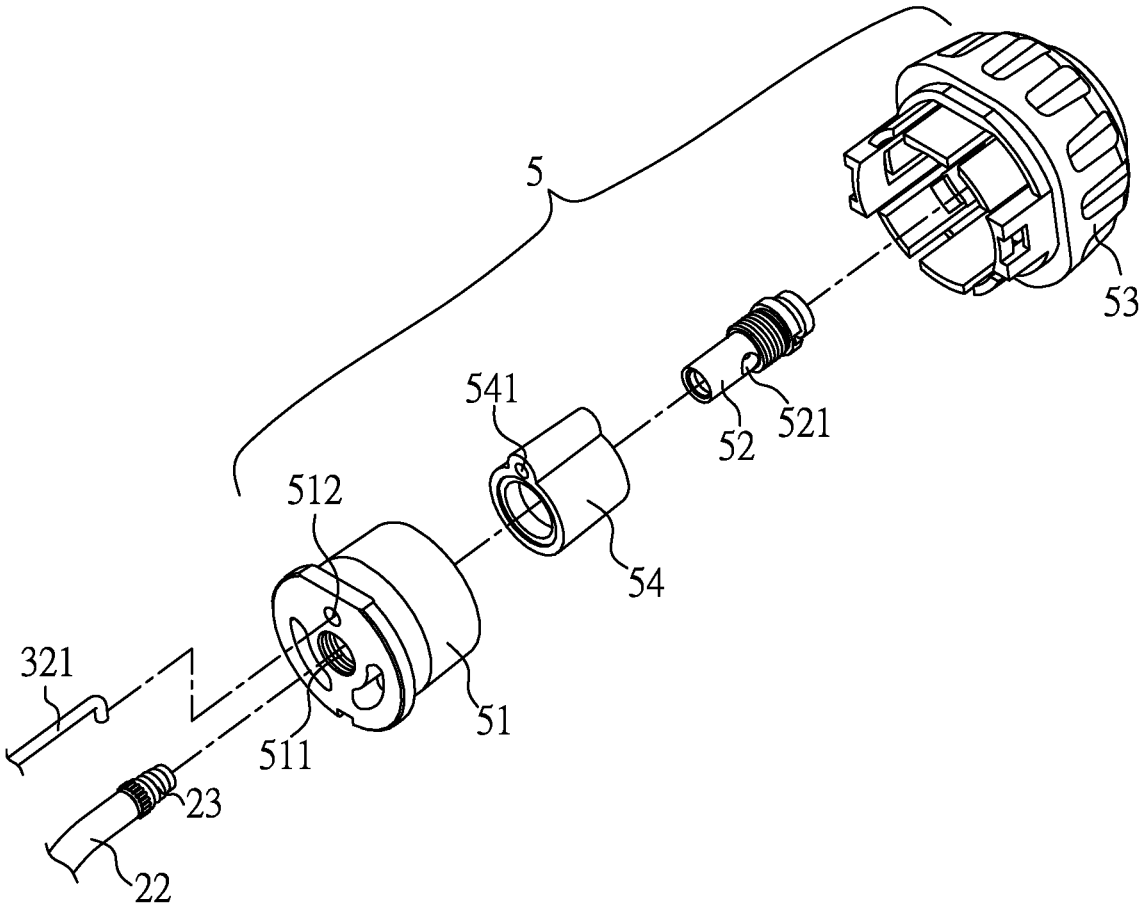
FIG. 7 is a perspective exploded view illustrating the combusting device according the present invention.

As shown in FIG. 1, FIG. 2 and FIG. 7, the combusting device 5 is disposed at a front opening 66 of the housing 6, and the combusting device 5 has a fastening seat 51 made of a metal material, for example an aluminum alloy, a seat hole 511 allowing a flame nozzle 52 to be disposed and a first wire slot 512 allowing the electric conducting wire 321 to pass are respectively formed at a central portion and a peripheral surface of the fastening seat 51, the gas ejecting nozzle 23 is combined with the flame nozzle 52, and at least one air inlet hole 521 is formed on a peripheral surface of the flame nozzle 52 for introducing external air into the flame nozzle 52, and the introduced air is mixed with the fuel gas ejected from the gas ejecting nozzle 23 so as to facilitate the combusting operation. The fastening seat 51 is disposed in an end cover 53, and the end cover 53 is arranged at the front opening 66 of the housing 6, so that the returning wire 322 can be electrically connected to the fastening seat 51, and a gap having a small distance is formed between the electric conducting wire 321 and the flame nozzle 52.

When the safety switch 4 is in the unlocked status, the press button 31 is pressed by a user for allowing the piezoelectric device 32 to be compressed, a generated high-pressure static electricity is transferred to a location where the flame nozzle 52 is arranged through passing the electric conducting wire 321, so that a spark can be generated between the electric conducting wire 321 and the flame nozzle 52 for igniting the mixed fuel gas ejected from the flame nozzle 52 so as to perform a combusting operation. The high-pressure static electricity is able to pass the fastening seat 51 and the returning wire 322 to return to the piezoelectric device 32, thereby forming a current loop.

For forming a better safety effect, a heat insulation sleeve 54 is disposed at an outer side of the flame nozzle 52, the heat insulation sleeve 54 is a pipe member made of a ceramic material, and a peripheral surface thereof is formed with a second wire slot 541 allowing the electric conducting wire 321 to be received.

The housing 6 is composed of a left housing part 61 and a right housing part 62 being mutually engaged with each other, so that the storage cylinder 1 and the fuel gas controlling device 2 can be enclosed in the housing 6. A bottom hole 67 is formed on a bottom end of the housing 6 and arranged at a location corresponding the gas filling nozzle on the bottom surface of the storage cylinder 1, The rear opening 63 allowing the press part 312 of the press button 31 to protrude and the clamp slot 64 allowing the push button 422 of the safety switch 4 to protrude are adjacently arranged on an upper portion defined on a back surface of the housing 6, and the front opening 66 allowing the combusting device 5 to be disposed is arranged on an upper portion defined at the front end of the housing 6.

Moreover, at least one ventilation slot 68 is formed at at least one side of the front opening 66 of the housing 6, so that air can be introduced into the at least one air inlet hole 521 for providing a combustion assisting effect.

Figure 13:
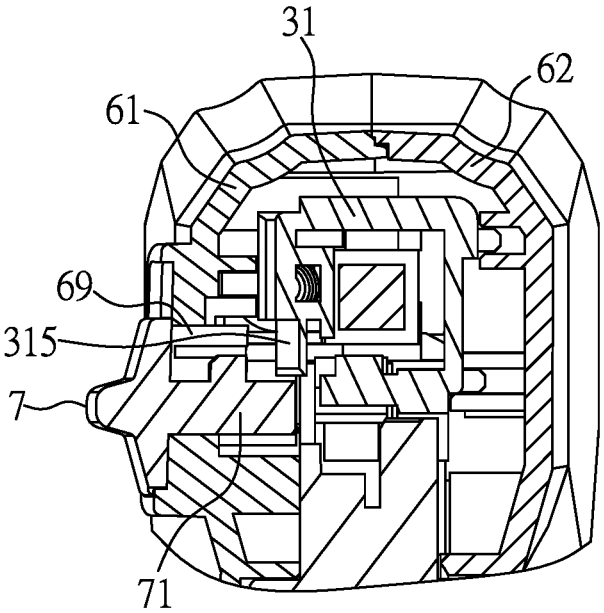
FIG. 13 is a cross sectional view illustrating the continuous button yet being operated according to the present invention.
Figure 14:
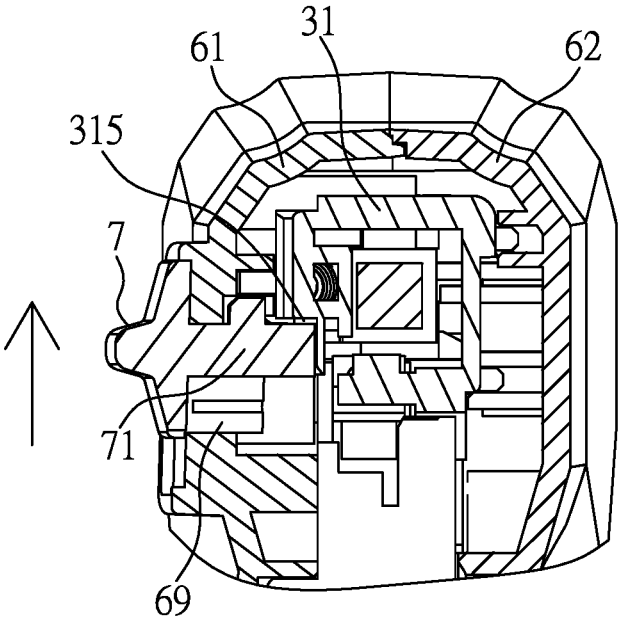
FIG. 14 is a cross sectional view illustrating the continuous button being operated and forming an interfering status with the press button according to the present invention.

For providing a continuously combusting function, a longitudinal sliding slot 69 allowing a continuous button 7 to be received is formed on a lateral surface, corresponding to the location where the press button 31 is disposed, of the housing 6, an action stopping rod 71 is inwardly protruded from the continuous button 7, an action stopping slot 315 is formed in the press button 31 corresponding to a moving path of the action stopping rod 71. Please refer to FIG. 13, when then press button 31 is in the locked status, the action stopping rod 71 of the continuous button 7 is abutted against a bottom edge of the press button 31, thereby being unable to be upwardly pulled. Please refer to FIG. 14, when the press button 31 is in the unlocked status and kept being pressed, the fuel gas controlling device 2 forms a fuel gas supplying status, the continuous button 7 is upwardly pulled, thus the action stopping rod 71 is displaced in the action stopping slot 315 so as form a locked (interfered) status, thus the press button 31 is prevented from being elastically recovered, and an gas continuously supplying status can be formed.

Figure 8:
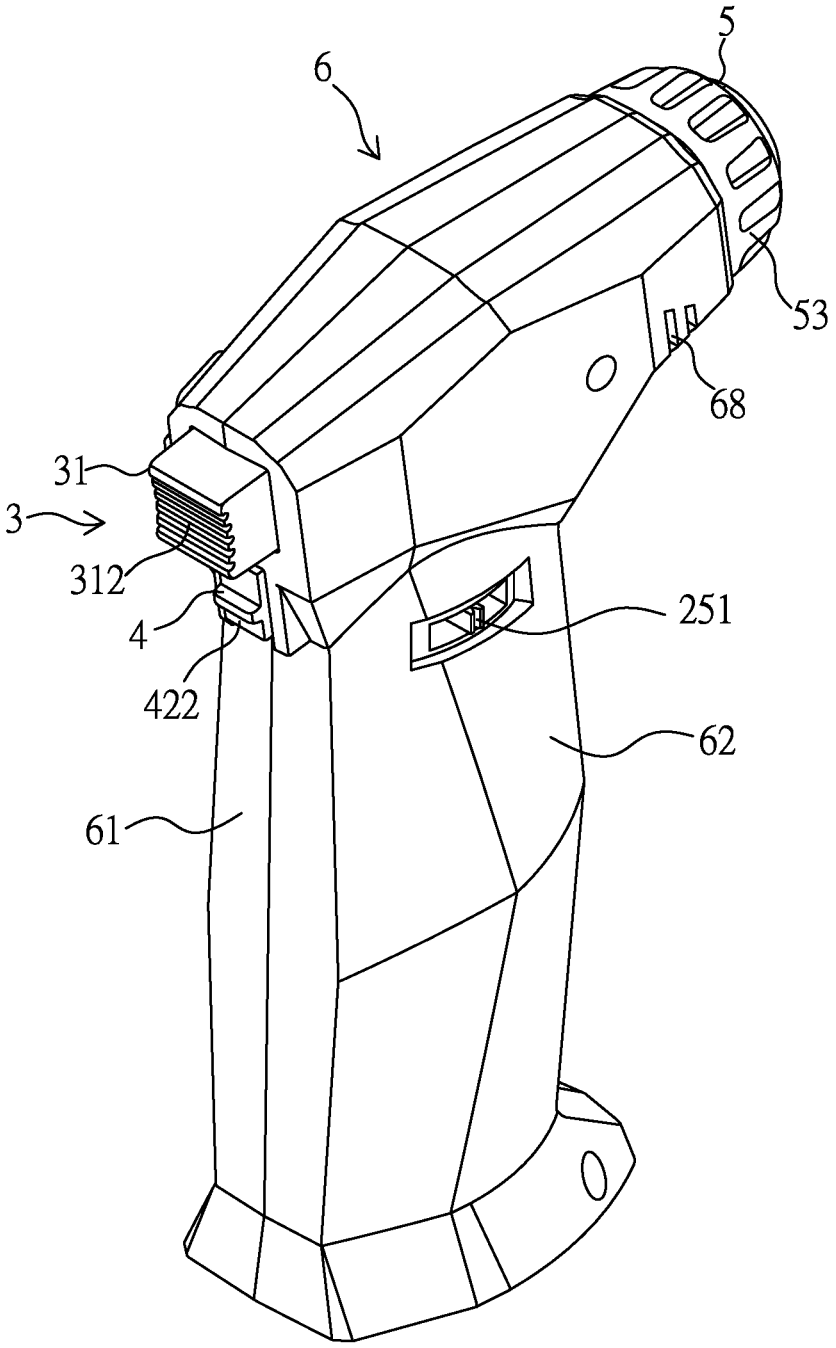
FIG. 8 is a perspective view illustrating the assembly of the combusting device according the present invention.
Figure 9:
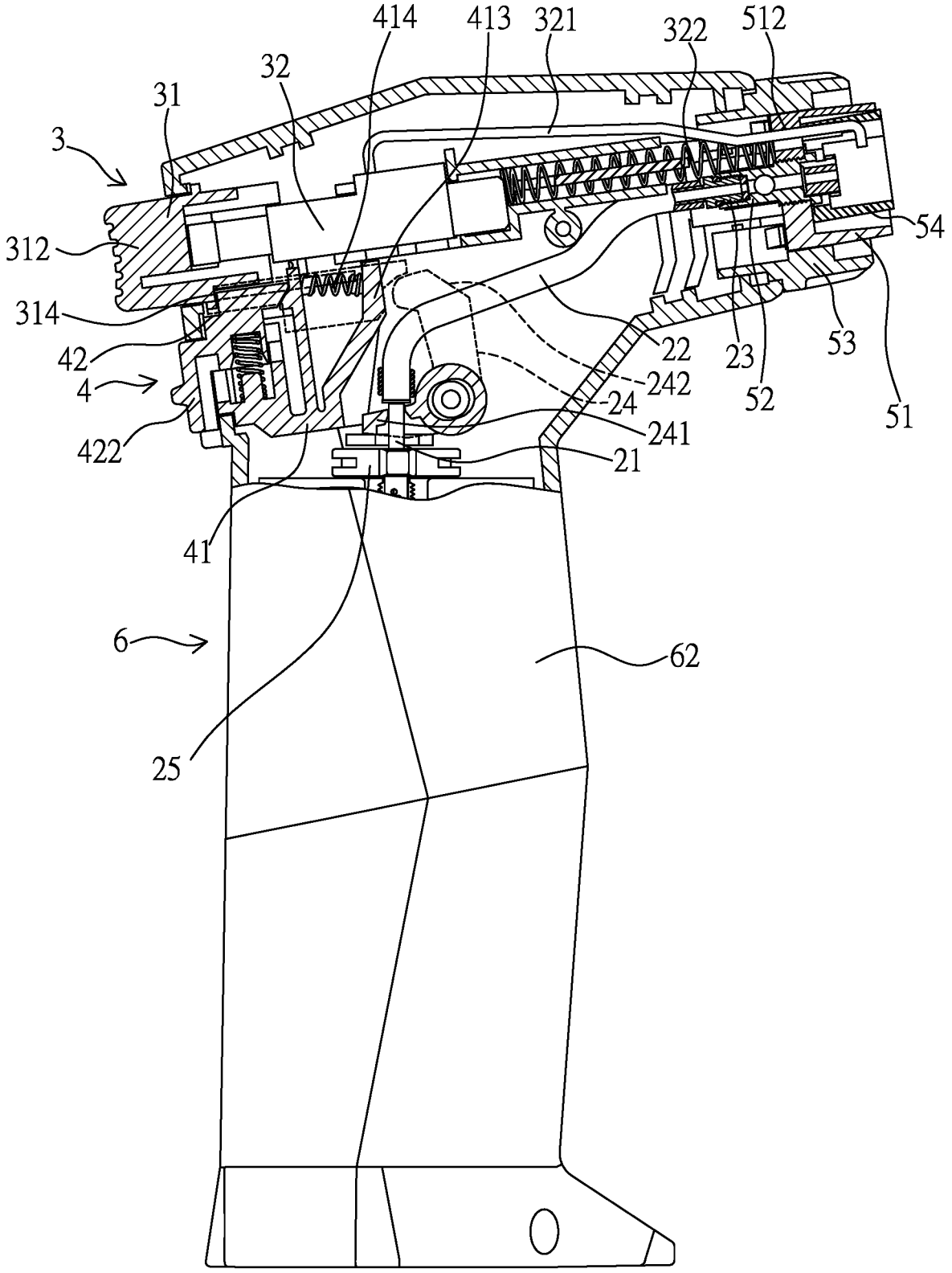
FIG. 9 is a cross sectional view illustrating the assembly of the combusting device according the present invention.

According to the illustrations provided to the above-mentioned components, the assembly of the gas combustor provided by the present invention is as shown in FIG. 8, and FIG. 9 is a cross sectional view illustrating the assembly of the gas combustor provided by the present invention.

Figure 10:
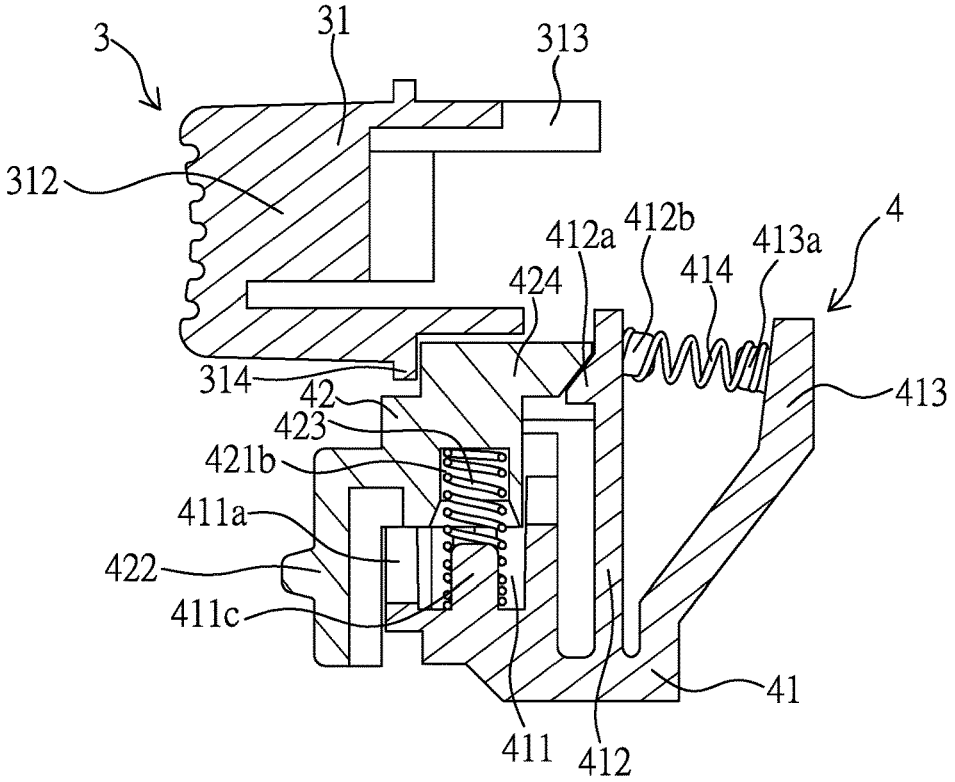
FIG. 10 is a cross sectional view illustrating an unlocking process of the locking unit of the safety switch according to the present invention.

Please refer from FIG. 9 to FIG. 12, which are cross sectional views illustrating an unlocking process of the locking unit 42 of the safety switch 4 according to the present invention. As shown in FIG. 10, when the press button 31 and the safety switch 4 are not in an operating status, the locking hook 424 is adjacently connected to the latching hook 412*a*, and the locking bolt 314 is abutted against the locking unit 42, thereby forming a non-pressing and locked status. At this moment, the longitudinal spring 423 and the transversal spring 414 are both in a stretching (energy releasing) status.

Figure 11:
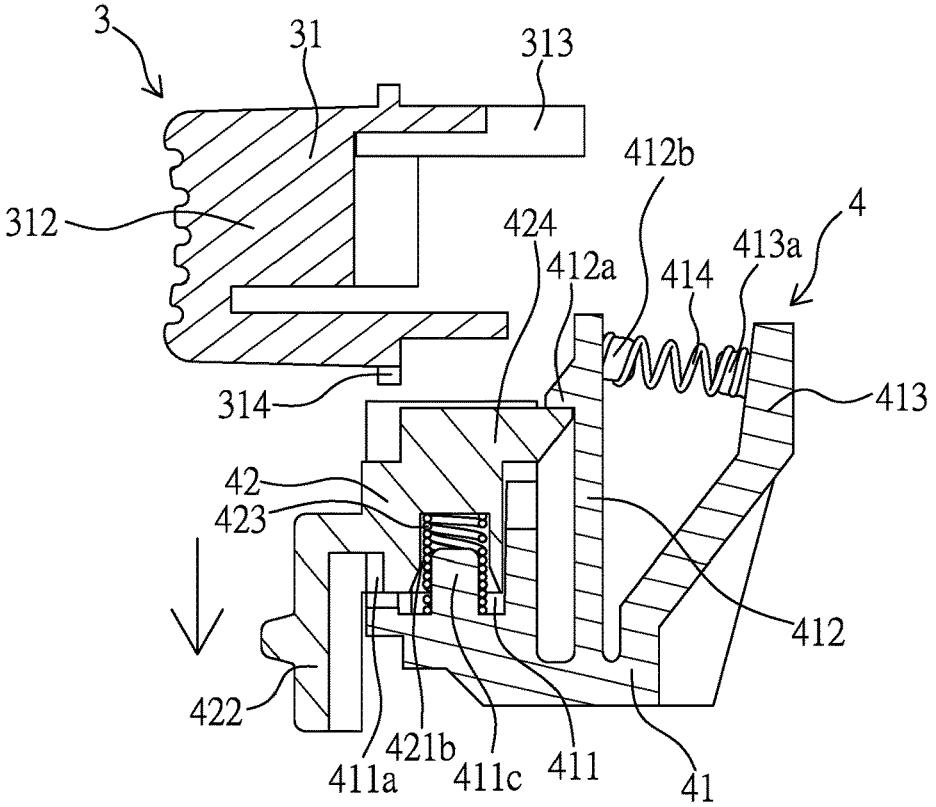
FIG. 11 is another cross sectional view illustrating the unlocking process of the locking unit of the safety switch according to the present invention.

As shown in FIG. 11, when an unlocking operation is desired to be process, the push button 422 of the locking unit 42 is longitudinally and downwardly pushed by the user for compressing the longitudinal spring 423, and the locking hook 424 at the top end of the main body 421 is downwardly displaced along the latching hook 412*a* so as to form a mutual abutting status, so that the locking bolt 314 is no longer abutted by the locking unit 42, thereby forming a pressing and unlocked status.

Figure 12:
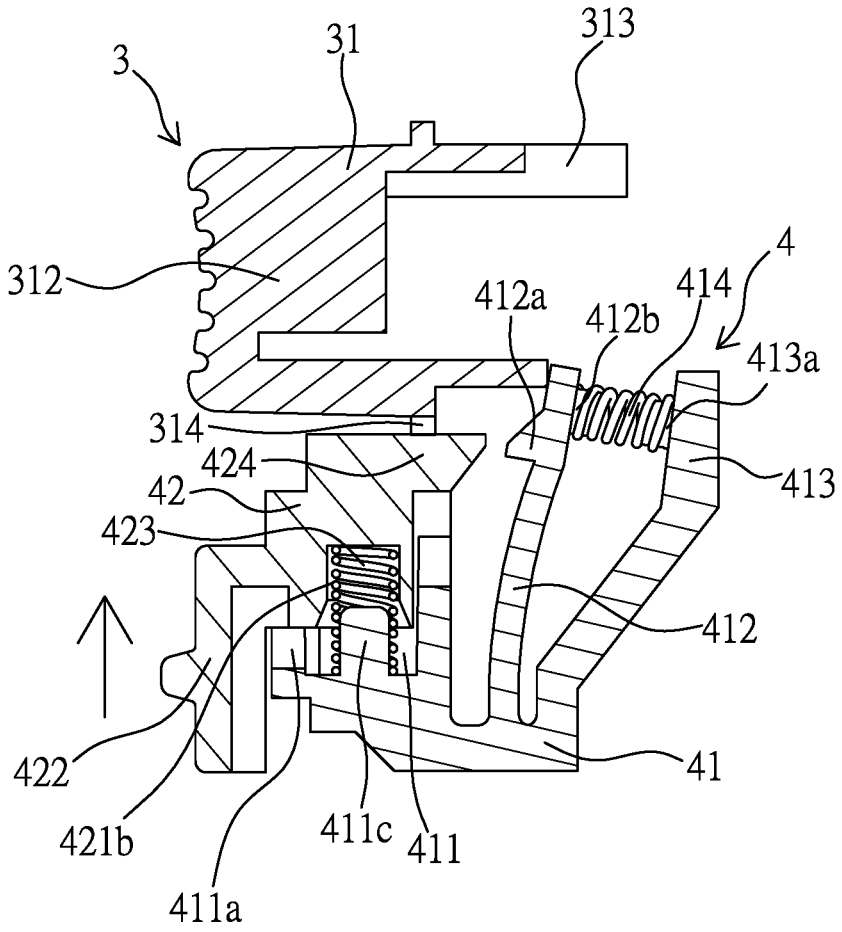
FIG. 12 is still another cross sectional view illustrating the unlocking process of the locking unit of the safety switch according to the present invention.

As shown in FIG. 12, when the press button 31 is pressed by the user, the piezoelectric device 32 and the auxiliary spring 33 are synchronously compressed, and the gas discharging press plate 24 is pushed for enabling the fuel gas controlling device 2 to ignite the supplied fuel gas ejected from the flame nozzle 52 through the high-pressure static spark transferred by the electric conducting wire 321; and the swing arm 412 is deformed to be forwardly inclined to compress the transversal spring 414, so that the latching hook 412*a* can be released from the locking hook 424, and the locking unit 42 is able to be upwardly displaced due to the energy releasing status of the longitudinal spring 423 for enabling a top surface thereof to be in contact with the locking bolt 314.

At this moment, if the combusting operation is desired to be continued, the press button 31 is stilled pressed by the user for being remained in a pressed status, and the continuous button 7 is upwardly pulled by another hand of the user, thus the action stopping rod 7 is displaced into the action stopping slot 315 of the press button 31 for forming a locked status, the press button 31 is prevented from being elastically recovered, thereby forming a gas continuously supplying status.

When the combusting operation is finished, the continuous button 7 is downwardly pulled by the user, so that the action stopping rod 71 is released from the action stopping slot 315, thereby releasing the locked status and terminating the gas supply; at this moment, the press button 31 is backwardly displaced through the piezoelectric device 32 and the energy releasing effect of the auxiliary spring 33, thus the gas discharging press plate 24 is no longer supported by the press button 31 and no longer provided with the energy releasing effect of the gas discharging nozzle 21, the gas discharging press plate 24 and the gas discharging nozzle 21 are both recovered to original locations, so that the fuel gas supply is terminated, and the combusting flame of the flame nozzle 52 is ceased; the locking bolt 314 is also backwardly displaced along the top surface of the locking unit 42, so that the swing arm 412 is able to be recovered to an original location through a self-elasticity of the swing arm 412 or the energy releasing effect being provided by the transversal spring 414, till the locking bolt 314 is displaced to the outer side of the locking unit 42, and during the abutting process, the locking unit 42 is able to utilize the energy releasing effect of the transversal spring 423 to allow the locking hook 424 to across the latching hook 412*a* and be adjacently connected to the latching hook 412*a*, thereby forming an automatically locking status as shown in FIG. 10.

Based on what has been disclosed above, advantages achieved by the present invention are as follows. The safety switch is provided with dual function of manually unlocking and automatically locking after being integrated, thereby increasing the safety in operation and the durability in use; because the manually unlocking process is very complicated and difficult, children can be prevented from operating which may cause unpredictable accidents, thereby complying with safety regulations issued by countries such as the America or the European Union; moreover, when the combusting operation is desired to be stopped, a terminating status of the press button being pressed or an interfered status of the continuous button are released for allowing the safety switch, the piezoelectric device and the gas discharging press plate to be recovered to the original locations, so that the fuel gas supply is terminated for ceasing the flame, and the automatically locked status can be established; accordingly, the present invention is designed in order to provide a convenient operation to the consumers, and the present invention is novel and more practical in use comparing to prior arts.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas combustor, including:

a housing used for enclosing a storage cylinder and a fuel gas controlling device disposed on a top end of said storage cylinder, a rear opening allowing a press button of an igniting device to protrude and a clamp slot allowing a safety switch to protrude are adjacently arranged on an upper portion defined on a back surface of said housing, and a front opening allowing a combusting device to be disposed is arranged on an upper portion defined at a front end of said housing; said fuel gas controlling device has a gas discharging press plate allowing said press button to be abutted and pivoted in said housing, a piezoelectric device is disposed in said press button, said piezoelectric device has an electric conducting wire extended to a flame nozzle of said combusting device and spaced from said flame nozzle with a gap; wherein said safety switch has a fastening unit and a locking unit abutted against a locking bolt formed on a bottom surface of said press button; said fastening unit has an accommodation chamber allowing said locking unit to be accommodated, and a swing arm having a latching hook is longitudinally disposed in front of said accommodation chamber with an interval; said locking unit has a main body accommodated in said accommodation chamber, a longitudinal spring is disposed between said main body and said accommodation chamber, and said main body has a push button protruded from a penetrated slot longitudinally formed on a rear wall of said accommodation chamber, and a locking hook protruded towards said latching hook; when said push button is not downwardly pushed, said locking hook is adjacently connected to said latching hook, and said locking bolt is abutted against said locking unit, thereby forming a non-pressing and locked status; when said push button is longitudinally and downwardly pushed, said longitudinal spring is compressed, and said locking hook at a top end of said main body is downwardly displaced along said latching hook for forming a mutual abutting status, so that said locking bolt is no longer abutted by said locking unit, thereby forming a pressing and unlocked status, said press button is able to be pressed for compressing said piezoelectric device, said gas discharging press plate is pressed and said swing arm is forwardly inclined so as to be deformed and moved toward a vertical column of the fastening unit, said locking hook is released from said latching hook, so that said locking unit is able to be upwardly displaced due to an energy releasing status provided by said longitudinal spring for enabling a top surface of said locking unit to be in contact with said locking bolt;

wherein the fastening unit having the accommodation chamber, the vertical column, and the swing arm; the accommodation chamber, the vertical column, and the swing arm being integrally formed as a single piece; and the swing arm being located between the accommodation chamber and the vertical column.

2. The gas combustor as claimed in claim 1, wherein said vertical column is arranged at a front end of said swing arm, a transversal spring is disposed between said vertical column and said swing arm; when said press button is in an automatically locked status, a releasing effect provided by said transversal spring is applied to said swing arm for assisting said locked status in a vertical direction to be recovered.

3. The gas combustor as claimed in claim 2, wherein two ends of said transversal spring are respectively sleeved on a first spring tenon and a second spring tenon oppositely arranged on said swing arm and said vertical column.

4. The gas combustor as claimed in claim 1, wherein at least one lateral wall of said accommodation chamber has an anti-releasing slot; said main body has an anti-releasing tenon received in said anti-releasing slot and arranged at a location corresponding to each of said anti-releasing slots, so that said locking unit is prevented from longitudinally releasing from said accommodation chamber.

5. The gas combustor as claimed in claim 1, wherein said longitudinal spring is sleeved between a spring slot and a spring column oppositely formed on said main body and said accommodation chamber.

6. The gas combustor as claimed in claim 1, wherein two lateral walls of said fastening unit are respectively formed with at least one positioning tenon, and an inner wall of said clamp slot of said housing is correspondingly formed with at least one positioning hole allowing said at least one positioning tenon to be inserted and positioned.

7. The gas combustor as claimed in claim 1, wherein said fuel gas controlling device has a gas discharging nozzle used for controlling whether fuel gas being supplied, said gas discharging nozzle is sleeved with one end of a gas conveying pipe, and another end of said gas conveying pipe is sleeved with a gas ejecting nozzle, a lifting plate disposed at one end of said gas discharging press plate is sleeved with said gas discharging nozzle, and a passive plate disposed at another end thereof is abutted against a push rod of said press button.

8. The gas combustor as claimed in claim 7, wherein said combusting device has a fastening seat made of a metal material, a seat hole allowing said flame nozzle to be disposed and a first wire slot allowing said electric conducting wire to pass are respectively formed at a central portion and a peripheral surface of said fastening seat, said gas discharging nozzle is combined with said flame nozzle formed with at least one air inlet hole on a peripheral surface thereof, said fastening seat is disposed in an end cover, and said end cover is arranged at said front opening.

9. The gas combustor as claimed in claim 8, wherein a press part protruded from of said rear opening is disposed at a rear side of said press button; and said piezoelectric device has a returning wire being in contact with said fastening seat.

10. The gas combustor as claimed in claim 7, wherein said press button is further connected to an auxiliary spring in a direction defined being parallel and opposite to said push rod, and two ends of said auxiliary spring are disposed at a button tenon of said press button and an inner wall of said housing.

11. The gas combustor as claimed in claim 7, wherein a heat insulation sleeve is disposed at an outer side of said flame nozzle, said heat insulation sleeve is a pipe member made of a ceramic material, and a peripheral surface thereof is formed with a second wire slot allowing said electric conducting wire to be received.

12. The gas combustor as claimed in claim 1, wherein a longitudinal sliding slot allowing a continuous button to be received is formed on a lateral surface, corresponding to a location where said press button is disposed, of said housing, an action stopping rod is inwardly protruded from said continuous button, an action stopping slot is formed in said press button corresponding to a moving path of said action stopping rod; when said press button is in said unlocked status and kept being pressed, said continuous button is upwardly pulled, thus said action stopping rod is displaced in said action stopping slot so as form a locked status, thus said press button is prevented from being elastically recovered, and an gas continuously supplying status is formed.

13. A safety switch of a gas combustor, including:

a fastening unit and a locking unit abutted against a locking bolt formed on a bottom surface of a press button; said fastening unit has an accommodation chamber allowing said locking unit to be accommodated, and a swing arm having a latching hook is longitudinally disposed in front of said accommodation chamber with an interval; said locking unit has a main body accommodated in said accommodation chamber, a longitudinal spring is disposed between said main body and said accommodation chamber, and said main body has a push button protruded from a penetrated slot longitudinally formed on a rear wall of said accommodation chamber, and a locking hook protruded towards said latching hook; when said push button is not downwardly pushed, said locking hook is adjacently connected to said latching hook, and said locking bolt is abutted against said locking unit, thereby forming a non-pressing and locked status; when said push button is longitudinally and downwardly pushed, said longitudinal spring is compressed, and said locking hook at a top end of said main body is downwardly displaced along said latching hook for forming a mutual abutting status, so that said locking bolt is no longer abutted by said locking unit, thereby forming a pressing and unlocked status, said swing arm is forwardly inclined and deformed toward a vertical column of the fastening unit, said locking hook is released from said latching hook, so that said locking unit is able to be upwardly displaced due to an energy releasing status provided by said longitudinal spring for enabling a top surface of said locking unit to be in contact with said locking bolt;

wherein the fastening unit having the accommodation chamber, the vertical column, and the swing arm; the accommodation chamber, the vertical column, and the swing arm being integrally formed as a single piece; and the swing arm being located between the accommodation chamber and the vertical column.

14. The safety switch of the gas combustor as claimed in claim 13, wherein said vertical column is arranged at a front end of said swing arm, a transversal spring is disposed between said vertical column and said swing arm; when said press button is in an automatically locked status, a releasing effect provided by said transversal spring is applied to said swing arm for assisting said locked status in a vertical direction to be recovered.

15. The safety switch of the gas combustor as claimed in claim 14, wherein two ends of said transversal spring are respectively sleeved on a first spring tenon and a second spring tenon oppositely arranged on said swing arm and said vertical column.

16. The safety switch of the gas combustor as claimed in claim 13, wherein at least one lateral wall of said accommodation chamber has an anti-releasing slot; said main body has an anti-releasing tenon received in said anti-releasing slot and arranged at a location corresponding to each of said anti-releasing slots, so that said locking unit is prevented from longitudinally releasing from said accommodation chamber.

17. The safety switch of the gas combustor as claimed in claim 13, wherein said longitudinal spring is sleeved between a spring slot and a spring column oppositely formed on said main body and said accommodation chamber.

18. The safety switch of the gas combustor as claimed in claim 13, wherein two lateral walls of said fastening unit are respectively formed with at least one positioning tenon, and an inner wall of said clamp slot of said housing is correspondingly formed with at least one positioning hole allowing said at least one positioning tenon to be inserted and positioned.

* * * * *